US007384290B2

(12) United States Patent
Fukumasu et al.

(10) Patent No.: US 7,384,290 B2
(45) Date of Patent: Jun. 10, 2008

(54) CONNECTOR AND RECORDING APPARATUS HAVING THE SAME

(75) Inventors: Keiichiro Fukumasu, Kitakyushu (JP); Yosuke Nakano, Suwa (JP); Satoshi Kaneta, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/710,201

(22) Filed: Feb. 22, 2007

(65) Prior Publication Data

US 2007/0224874 A1 Sep. 27, 2007

(30) Foreign Application Priority Data

Feb. 22, 2006 (JP) ..... 2006-045905

(51) Int. Cl.
*H01R 4/60* (2006.01)

(52) U.S. Cl. ..... 439/206

(58) Field of Classification Search ..... 439/190, 439/206, 205

See application file for complete search history.

(56) References Cited

U.S. PATENT DOCUMENTS 7,226,294 B2 * 6/2007 Shirai et al. ..... 439/66
2007/0149044 A1 * 6/2007 Asauchi ..... 439/534

FOREIGN PATENT DOCUMENTS

| | | |
|---|---|---|
| JP | 8-298157 | 11/1996 |
| JP | 2000-82526 | 3/2000 |
| JP | 2000-208184 | 7/2000 |

* cited by examiner

*Primary Examiner*—Ross N Gushi
(74) *Attorney, Agent, or Firm*—John J. Penny, Jr.; Edwards Angell Palmer & Dodge LLP

(57) ABSTRACT

A connector includes: a housing; and a plurality of metal contacts supported so as to be parallel to each other with respect to the housing, each contact having a first contact arm and a second contact arm, and electrically connecting a first member and a second member to each other by bringing a first contact terminal of the first contact arm and a second contact terminal of the second contact arm into elastic contact with a conductive connection portion of the first member and a conductive connection portion of the second member respectively, the first member and the second member being disposed on both sides of the housing, wherein the housing has a through hole penetrating therethrough and formed on a side of the first contact terminal with respect to a first separation start position at which the first contact arm starts separation from the housing, and a second separation start position at which the second contact arm starts separation from the housing is disposed farther apart from the through hole than the first separation start position.

7 Claims, 9 Drawing Sheets

CONNECTOR AND RECORDING APPARATUS HAVING THE SAME

BACKGROUND

1. Technical Field

The present invention relates to a connector including a plurality of metal contacts supported so as to be parallel to each other with respect to the housing, each contact having a first contact arm and a second contact arm, and electrically connecting a first member and a second member to each other by bringing contact terminals of the first contact arm and the second contact arm into elastic contact with a conductive connection portion of the first member and a conductive connection portion of the second member, the first member and the second member being disposed on both sides of the housing and a recording apparatus having the connector.

2. Related Art

A connector used for interconnection between a substrate on the side of a cartridge mounted to a carriage of a recording apparatus and a substrate on a side of a recording apparatus body is disclosed in Patent Document 1. A plurality of contacts of the connector are pressed and fixed to a horizontal barrier wall from one end wall surface of a housing. At least a continuous end wall extending from both side walls and the horizontal barrier wall of the housing is disposed on the other end opposed to the one end wall surface. A space surrounded with the horizontal barrier wall and the continuous end wall and extending in a horizontal direction is formed in the back of contact arms constituting the contacts on one side of the horizontal barrier wall. In the invention disclosed in Patent Document 1 which provides such a space, when ink is unintentionally attached to one side of the horizontal barrier wall from the ink cartridge, the attached ink is collected to the space so as to prevent the attached ink from moving to the other side of the horizontal barrier wall, thereby suppressing the attached ink from reaching the main body side substrate.

Patent Document 1:JP-A-2000-208184

However, when the ink is attached to the housing in the vicinity of a separation start position at which a contact arm of the contact starts a separation from the horizontal barrier wall (housing), that is, in the vicinity of a bent portion of the contact arm, the attached ink enters the space formed in a portion of the bent portion where the contact arm and the housing contact each other by means of a capillary phenomenon, and thus easily gathers there. Then, the contact may be corroded at the position to deteriorate the elasticity of the contact arm and a predetermined contact load may not be obtained, thereby causing contact failure. The conductivity of the contact may be deteriorated due to the corrosion.

SUMMARY

An advantage of some aspects of the invention is to provide a connector having a configuration for preventing ink from gathering in the vicinity of a bent portion of a contact arm close to an ink cartridge.

The advantage can be attained by at least one of the following aspects:

A first aspect of the invention provides a connector comprising: a housing; and a plurality of metal contacts supported so as to be parallel to each other with respect to the housing, each contact having a first contact arm and a second contact arm, and electrically connecting a first member and a second member to each other by bringing a first contact terminal of the first contact arm and a second contact terminal of the second contact arm into elastic contact with a conductive connection portion of the first member and a conductive connection portion of the second member respectively, the first member and the second member being disposed on both sides of the housing, wherein the housing has a through hole penetrating therethrough and formed on a side of the first contact terminal with respect to a first separation start position at which the first contact arm starts separation from the housing, and a second separation start position at which the second contact arm starts separation from the housing is disposed farther apart from the through hole than the first separation start position.

For example, when ink is attached to a first surface of the connector from an ink cartridge and the ink gathers in the vicinity of the separation start position of the first contact arm from the housing, that is, in the vicinity of the bent portion, the contact may be corroded at the position. The through hole disposed in the vicinity of the bent portion prevents such a phenomenon and serves to actively discharge the ink gathering in the vicinity of the bent portion to the second surface through the through hole by means of the principle of capillary. Accordingly, the attached ink does not gather in the vicinity of the bent portion of the contact arm, thereby avoiding the corrosion of the contact at the position and thus stably maintaining a contact load of the first contact arm without any change.

On the second surface to which the attached ink is discharged, the separation start position of the second contact arm from the housing, that is, the bent portion, is more apart from the through hole than the bent portion of the first contact arm. Accordingly, the possibility that the ink enters the space formed in the bent portion of the second contact arm is small. The most ink discharged to the second surface stays in a region of the housing apart from the second contact arm and is dried with the lapse of time, thereby causing no problem.

A connector according to a second aspect of the invention is the connector according to the first aspect, wherein the contacts are arranged so that the first separation start positions of the first contact arms adjacent to each other are alternately arranged in a zigzag manner, and the through holes are arranged in the zigzag manner to correspond to the first separation start positions of the first contact arms.

In the second aspect, since the through holes are arranged in a zigzag manner to correspond to the separation start positions of the first contact arms, it is first possible to prevent the deterioration in rigidity of the housing due to the disposition of the through holes. Second, when the ink is discharged to the second surface through the through holes, the discharged positions are arranged in the zigzag manner, thereby facilitating the drying of the ink.

A connector according to a third aspect of the invention is the connector according to the first or second aspect, wherein the housing includes a thin plate-shaped portion to which a side of a base end portion of the contact is attached and a thick base portion located close to a side of the contact terminals of the contact.

In the use of the connector electrically connecting the first member and the second member to each other by bringing both contact arms into elastic contact with the conductive connection portion of the first member and the conductive connection portion of the second member with a predetermined contact load, a pressing force as a reaction of the elastic contact of the contact arms is applied to the housing from the separation start positions (bent portions). When the rigidity of the housing is small, the housing may be deformed by the pressing force and thus the predetermined contact load of the contact arms may not be guaranteed. However, in the third aspect, since the entire rigidity of the housing is enhanced due to the existence of the thick base portion, it is possible to suppress the deformation of the housing to a negligible extent against the pressing force. Therefore, since the housing is not deformed, the contact load of the contact arms can be stably maintained, thereby avoiding the contact failure of the contact terminals.

A connector according to a fourth aspect of the invention is the connector according to the third aspect, where in the second contact arm is shorter than the first contact arm, a tapered portion inclined so as to be apart from the second contact terminal of the second contact arm is formed at a position of the base portion facing the second contact terminal of the second contact arm, and the tapered portion is formed to extend from the through hole.

According to the fourth aspect, since the ink guided to the second surface through the through hole is guided along the tapered portion in a direction apart from the second contact arm and the contact terminal there of, the possibility that the ink comes in contact with the second contact arm and the contact terminal there of is very small.

According to a fifth aspect of the invention, there is provided a recording apparatus comprising the connector according to claim 1, wherein the conductive connection portion of the first member is a conductive connection portion of a cartridge side substrate disposed in an ink cartridge which is mounted to a carriage mounting a recording head and reciprocating in a scanning direction, and the conductive connection portion of the second member is a conductive connection portion of a main body side substrate disposed in the carriage.

According to the fifth aspect, even when the ink is attached to the surface of the housing of the connector close to the ink cartridge at the time of mounting or demounting the ink cartridge to or from the recording apparatus, a problem due to the attached ink can be avoided by means of the operation of the connector described above, thereby stably maintaining the electrical connection between the cartridge side substrate and the main body side substrate with a predetermined contact load. That is, since the transmission of information based on the ink cartridge in use can be reliably carried out between the cartridge side substrate and the main body side substrate, operational disorders in printing can be reduced.

The present disclosure relates to the subject matter contained in Japanese patent application No. 2006-045905 filed on Feb. 22, 2006, which is expressly incorporated herein by reference in its entirety.

BRIEF DESCRIPTION OF THE DRAWINGS

The invention will be described with reference to the accompanying drawings, wherein like numbers reference like elements.

FIG. 5A is a front view illustrating a state where contacts are attached to the connector and FIG. 5B is a front view illustrating a state where the contacts are detached from the connector.

DESCRIPTION OF EXEMPLARY EMBODIMENTS

Figure 1:
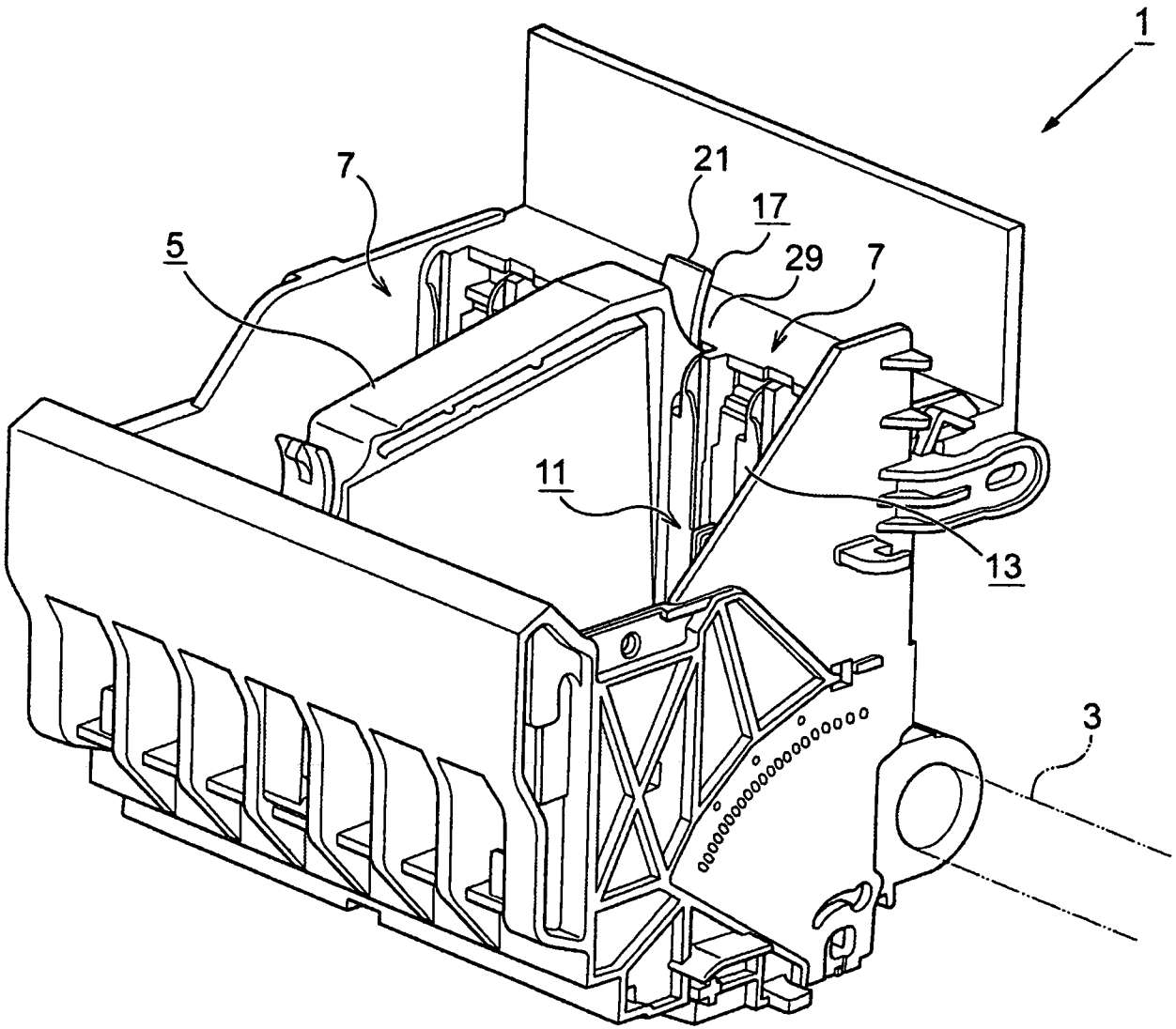
FIG. 1 is a perspective view illustrating a carriage of a recording apparatus employing a connector according to an embodiment of the invention.
Figure 2:
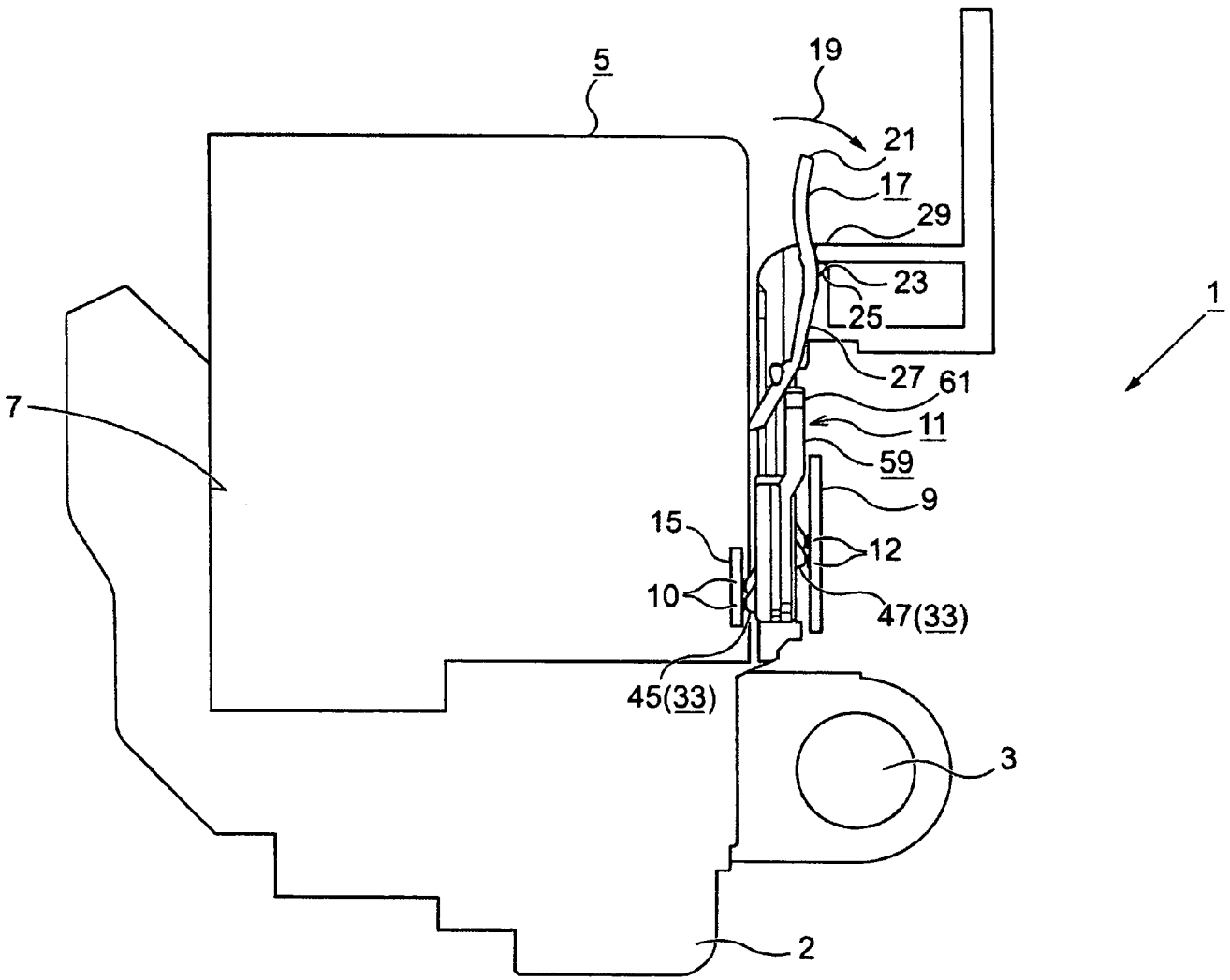
FIG. 2 is a side sectional view illustrating a state where an ink cartridge is mounted into the carriage.
Figure 3:
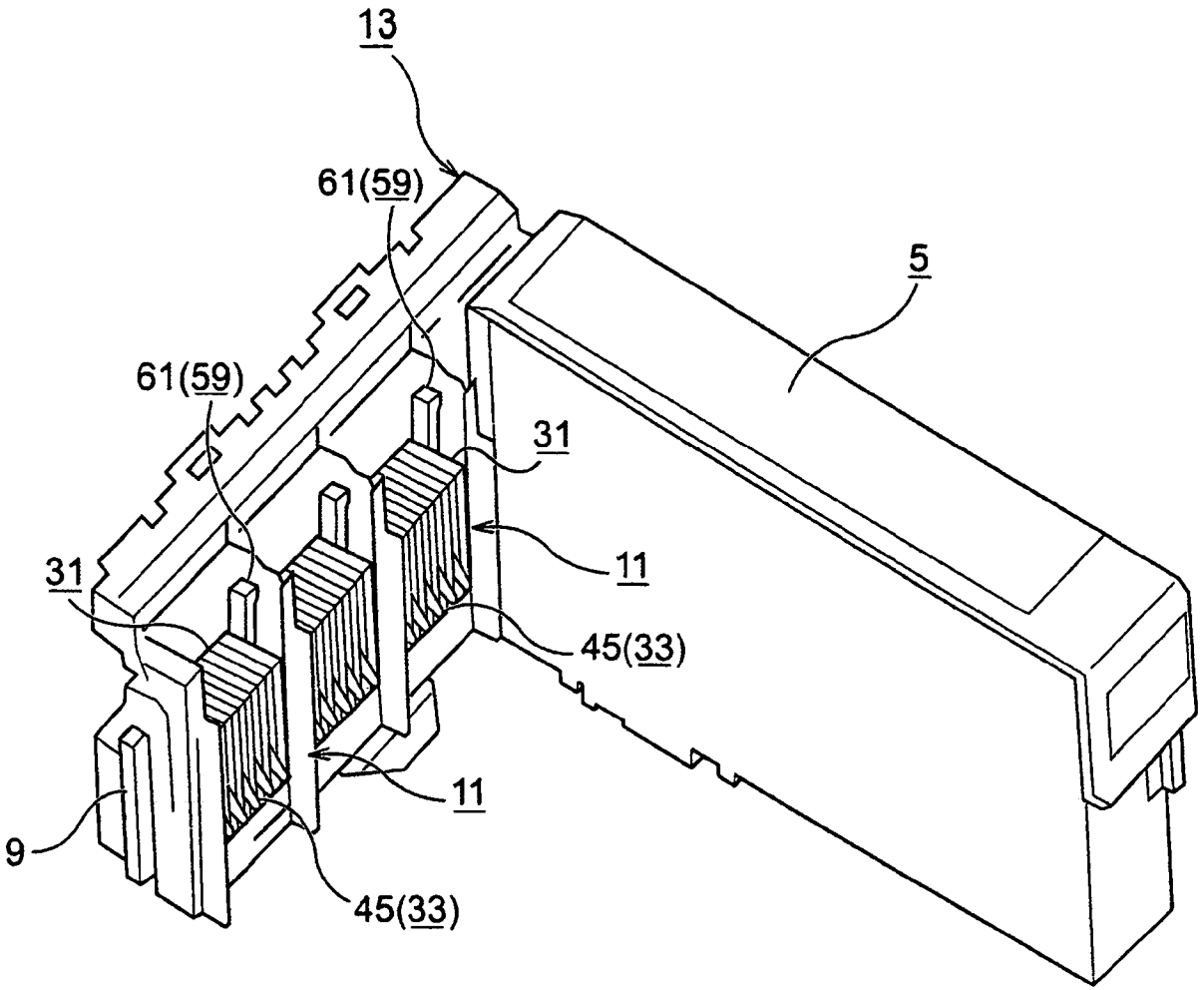
FIG. 3 is a perspective view illustrating a relation between the ink cartridge and the connector.
Figure 4:
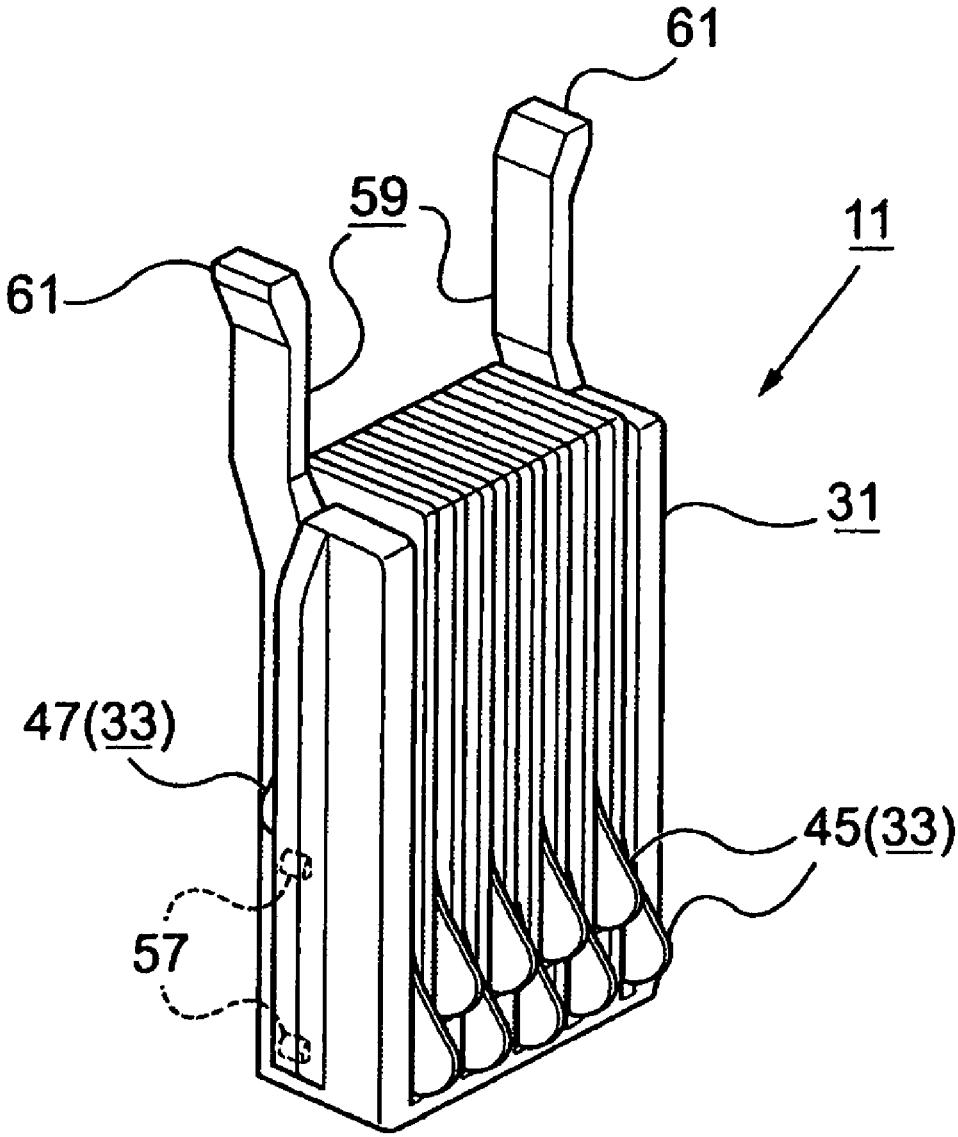
FIG. 4 is a perspective view illustrating the entire configuration of the connector.
Figure 5A:
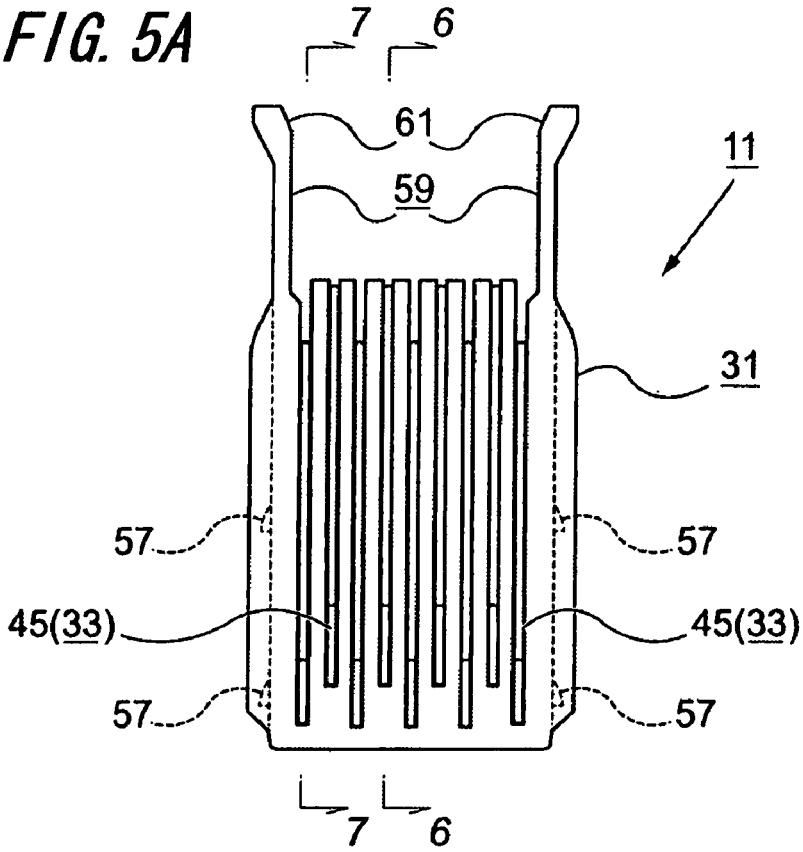
FIGS. 5A and 5B are front views illustrating a side of the connector facing the ink cartridge, where
Figure 5B:
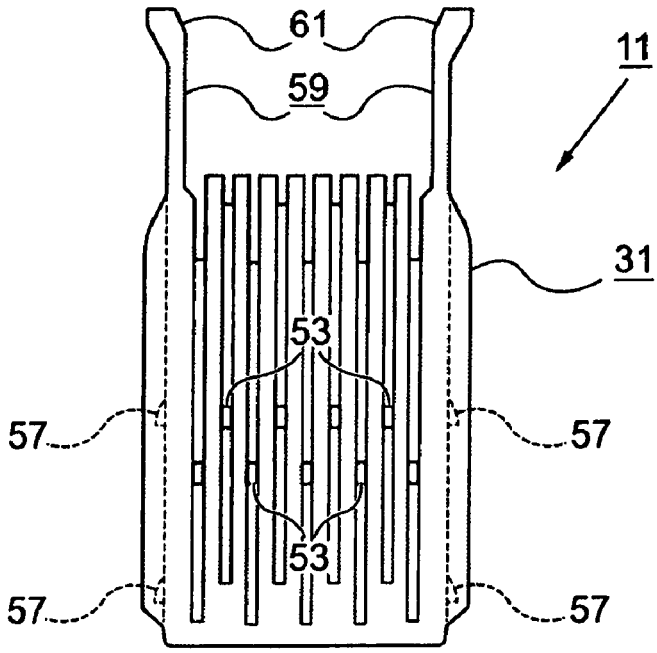
Figure 6:
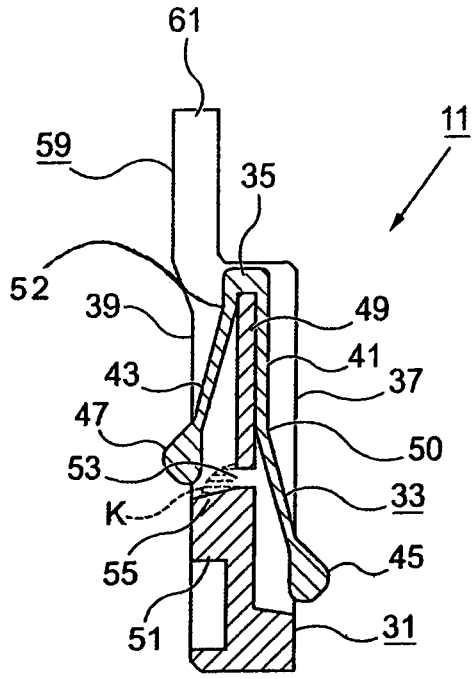
FIG. 6 is a side sectional view of the connector taken along Line VI-VI of FIG. 5A.
Figure 7:
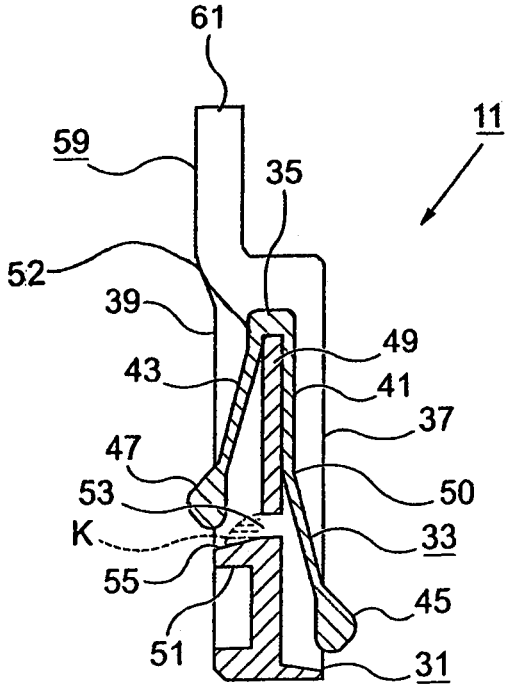
FIG. 7 is a side sectional view of the connector taken along Line VII-VII of FIG. 5A.

Hereinafter, an embodiment of the invention will be described with reference to the drawings. FIG. 1 is a perspective view illustrating a carriage of a recording apparatus employing a connector according to an embodiment of the invention, FIG. 2 is a side sectional view illustrating a state where an ink cartridge is mounted into the carriage, FIG. 3 is a perspective view illustrating a relation between the ink cartridge and the connector, and FIG. 4 is a perspective view illustrating the entire configuration of the connector. FIGS. 5A and 5B are front views illustrating a side of the connector facing the ink cartridge, where FIG. 5A is a front view illustrating a state where contacts are attached to the connector and FIG. 5B is a front view illustrating a state where the contacts are detached from the connector. FIG. 6 is a side sectional view of the connector taken along Line VI-VI of FIG. 5A and FIG. 7 is a side sectional view of the connector taken along Line VII-VII of FIG. 5A.

Figure 8:
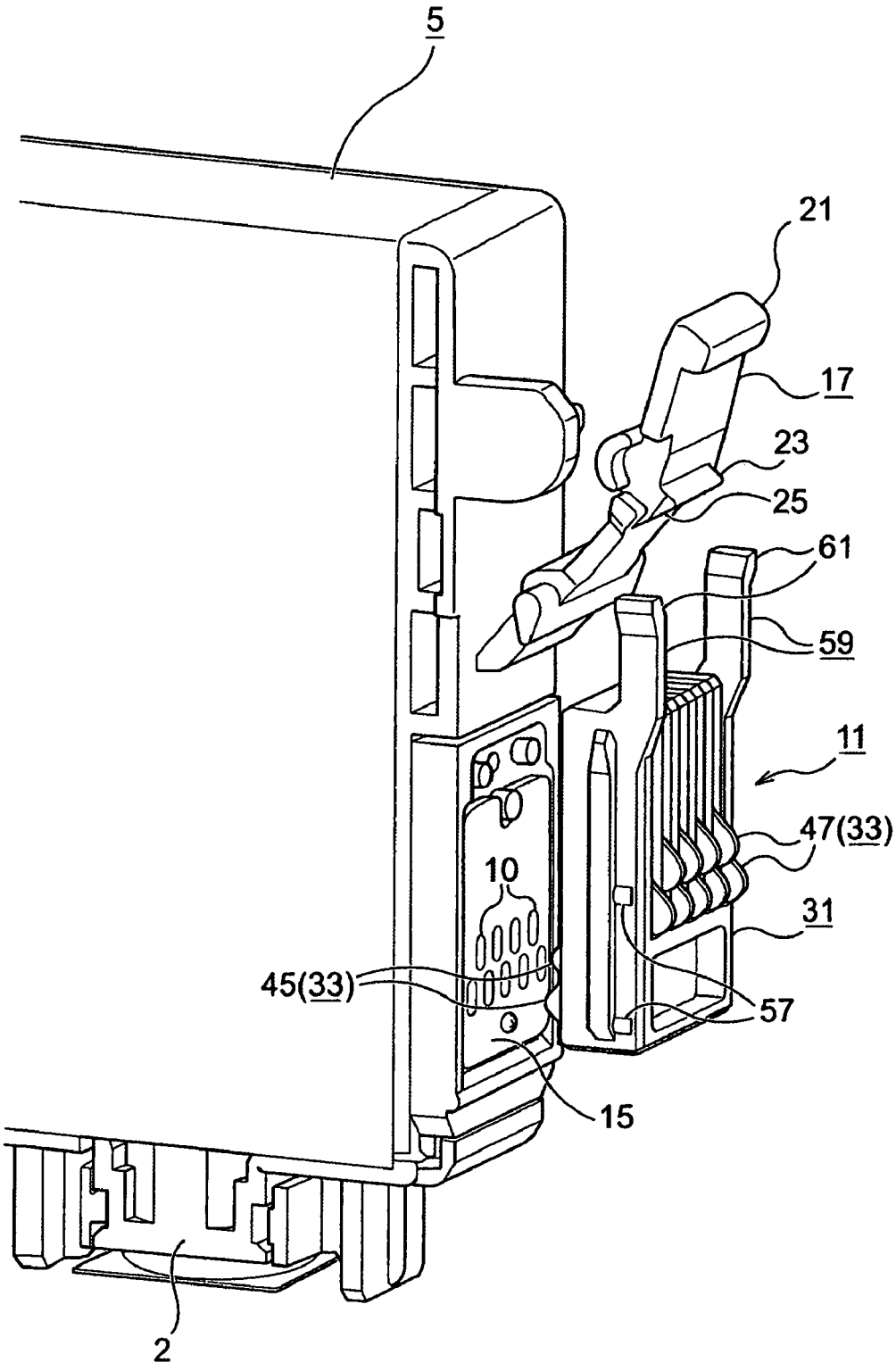
FIG. 8 is a perspective view illustrating a relation between the connector and the ink cartridge.
Figure 9:
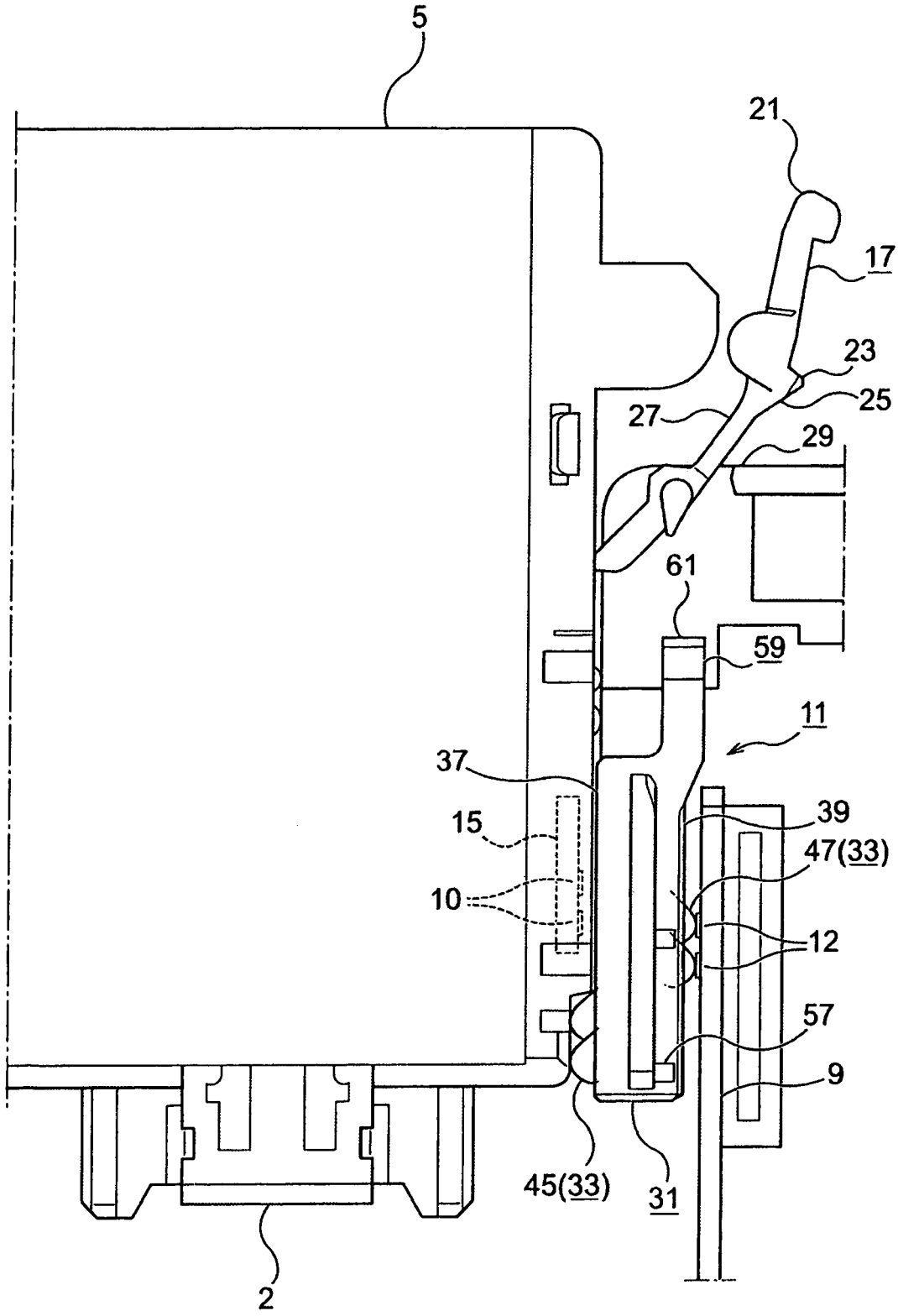
FIG. 9 is a side sectional view illustrating a state right before the mounting of the ink cartridge is completed.
Figure 10:
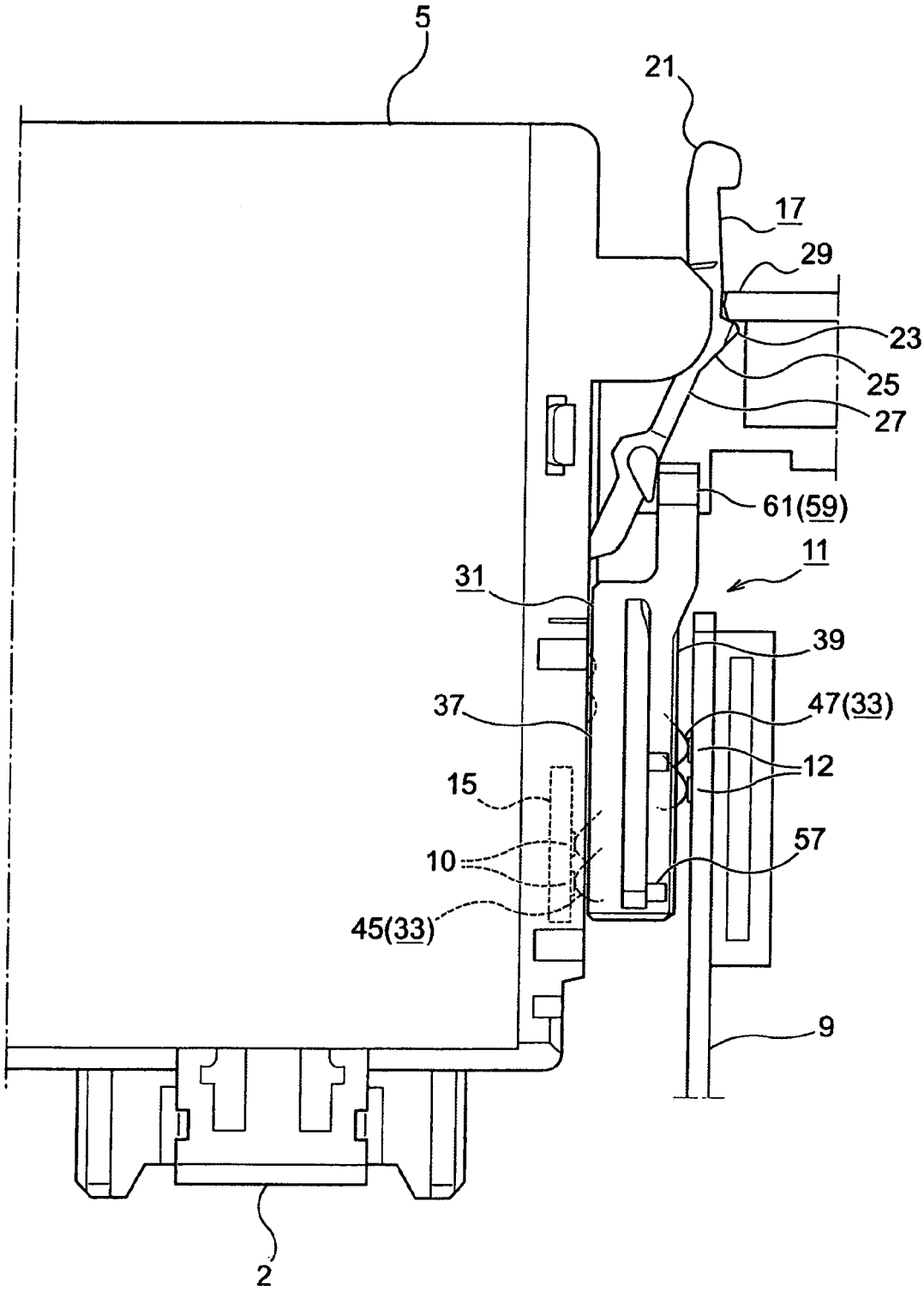
FIG. 10 is a side sectional view illustrating a state after the mounting of the ink cartridge is completed.

FIG. 8 is a perspective view illustrating a relation between the connector and the ink cartridge, FIG. 9 is a side sectional view illustrating a state right before the mounting of the ink cartridge is completed, and FIG. 10 is a side sectional view illustrating a state after the mounting of the ink cartridge is completed.

In FIG. 1, reference numeral 1 denotes a carriage and a recording head 2 (see FIG. 2) is disposed on the bottom of the carriage 1. The carriage 1 can reciprocate in a direction perpendicular to a feed direction of a printing medium along a carriage guide shaft 3 and performs a printing operation to the printing medium. A plurality of cartridge receiving sections 7 for receiving an ink cartridge 5 corresponding to a first member are formed in the carriage 1. A main body side substrate 9 (see FIG. 2) corresponding to a second member is disposed on the rear surface of the carriage 1. Conductive connection portions 12 are formed on the main body side substrate 9. A connector 11 is disposed on the inner surface of the carriage 1 facing the rear surface so as to correspond to each cartridge receiving sections 7. Each connector 11 is held by a connector holder 13 (see FIG. 3) and the connector holder 13 can be maintained in the carriage 1.

As shown in FIG. 8, in each ink cartridge 5, a cartridge side substrate 15 is formed on the surface facing the connector 11 and a lock lever 17 for fixing the ink cartridge 5 to the carriage 1 is disposed above the cartridge side substrate. Conductive connection portions 10 are formed on the cartridge side substrate 15.

As shown in FIG. 2, when the ink cartridge 5 is mounted into the carriage 1, the lock lever 17 is opened in the direction indicated by an arrow 19 by means of an operation portion (not shown) close to the carriage 1. A locking portion 23 is formed right below a handle 21 at the uppermost end of the lock lever 17 and the lower side of the locking portion 23 forms an inclined surface 25 obliquely formed. An arm portion 27 extending substantially linearly is formed below the locking portion 23.

By pushing the ink cartridge 5 into the cartridge receiving section 7, the inclined surface 25 is guided by a locking protrusion 29 formed in the carriage 1 and thus the lock lever 17 is temporarily deformed slightly elastically in the opposite direction of the arrow 19. Then, after the locking portion 23 passes through the locking protrusion 29, the shape of the lock lever 17 is restored in the direction of the arrow 19, whereby the locking portion 23 is locked to the lower portion of the locking protrusion 29 to fix the ink cartridge 5, as shown in FIGS. 2 and 10.

Next, a configuration of the connector 11 will be described with reference to FIGS. 4 to 7. As shown in FIG. 10, a first surface 37 of the connector 11 comes in contact with the cartridge side substrate 15 and a second surface 39 of the connector 11 comes in contact with a main body side substrate 9 disposed on the rear side of the carriage 1, whereby the cartridge side substrate 15 and the main body side substrate 9 are electrically connected to each other. As shown in FIG. 4 and FIGS. 5(A) and 5(B), the connector 11 is disposed on the housing 31 made of a known material so that 9 metal contacts 33 are parallel to each other. As show in FIGS. 4, 5A, 6, and 7, the 9 contacts 33 are arranged in two lines so as to be located at the same position every two contacts in a side view and the adjacent contacts 33 are disposed so as to depart from each other in the longitudinal direction of the housing 31, thereby forming a zigzag manner as a whole.

As shown in FIGS. 6 and 7, the contacts 33 have the same shape and each contact 33 mainly includes a first contact arm 41 extending toward the first surface 37 from a base end portion 35 and a second contact arm 43 extending toward the second surface 39. The second contact arm 43 is shorter than the first contact arm 41. Contact terminals 45 and 47 having a substantially semicircular shape are formed at the ends of the contact arms 41 and 43, respectively. The second contact arm 43 has a length smaller than that of the first contact arm 41. The contact 33 is pressed onto a thin plate-shaped portion 49 formed in the housing 31 and thus supported by the housing 31.

The first contact arm 41 extends in contact with the plate-shaped portion 49 in the middle portion there of, is bent outwardly from a bent portion 50 as a separation start portion from the plate-shaped portion 49, whereby the contact terminal 45 protrudes from the first surface 37 of the housing 31. When a load is applied to the contact terminal 45, the first contact arm 41 is curved inwardly like a leaf spring. The second contact arm 43 is opened outwardly from a bent portion 52 as a separation start portion which is disposed right aside the base end portion 35 and thus the contact terminals 47 protrudes from the second surface 39 of the housing 31. When a load is applied to the contact terminal 47, the second contact arm 43 is curved inwardly like a leaf spring.

A thick base portion 51 located close to the contact terminals 45 and 47 is formed in the housing 31, in addition to the thin plate-shaped portion 49. This configuration is not included in any known connector and is a feature of the invention. Since the total rigidity of the housing 31 is enhanced by forming the thick base portion 51 in the housing 31, it is possible to prevent the decrease in contact load due to the deformation of the housing 31 and contact failure of the contact terminals based thereon.

As shown in FIGS. 5B, 6, and 7, a small through hole 53 penetrating the housing 31 from the first surface 37 to the second surface 39 is formed closer to the contact terminal 45 of each first contact arm 41 than the bent portion 50. Then bent portion 52 which is located on the second surface 39 of the small through hole 53 and which is the separation start position of the second contact arm 43 from the plate-shaped portion 49 is disposed more apart from the bent portion 50 of the first contact arm 41 than the small through hole 53.

By forming such a small through hole 53, the following advantage can be obtained. That is, when ink from the ink cartridge 5 is attached to the first surface 37 of the connector 11 and thus the ink gathers in the vicinity of the bent portion 50 as the separation start position of the first contact arm 41 from the plate-shaped portion 49, the contact 33 may be corroded at the position. The small through hole 53 formed in the vicinity of the bent portion 50 serves to prevent such a corrosion and to actively discharge the ink gathering in the vicinity of the bent portion 50 to the second surface 39 through the small through hole 53 in a principle of capillary. Accordingly, the attached ink does not gather in the vicinity of the bent portion 50 of the first contact arm 41 and thus the corrosion of the contact 33 at the position can be prevented, thereby stably maintaining the contact load of the first contact arm 41 in a predetermined range without any change.

On the second surface 39 to which the attached ink is discharged, the bent portion 52 at the separation start position of the second contact arm 43 from the plate-shaped portion 49 is located more apart from the small through hole 53 than the bent portion 50 of the first contact arm 41. Accordingly, the possibility that the ink enters a gap formed in the bent portion 52 of the second contact arm 43 is small. The most ink discharged to the second surface 39 stays in a region of the housing 31 spaced apart from the second contact arm 43 and is dried with the lapse of time, thereby causing no problem.

Since the contacts 33 are arranged in a zigzag manner as a whole as described above, the bent portions 50 of the first contact arms 41 adjacent to each other are arranged in the zigzag manner. The small through holes 53 are also arranged in the zigzag manner to correspond to the positions of the bent portions 50 of the first contact arms 41. Accordingly, it is possible to prevent the deterioration in rigidity of the housing 31 due to the disposition of the small through holes 53. In addition, when the ink is discharged to the second surface 39 through the small through holes 53, the discharged positions are arranged in the zigzag, thereby facilitating the drying of the ink.

In this embodiment, a tapered portion 55 inclined to become apart from the contact terminal 47 of the second contact arm 43 is formed in a portion of the base portion facing the contact terminal 47 of the second contact arm 43. The tapered portion 55 extends successively from the small through hole 53. Accordingly, since the ink K guided into the second surface 39 through the small through hole 53 is guided along the surface of the tapered portion 55 in a direction apart from the second contact arm 43 and the contact terminal 47 there of, as shown in FIGS. 6 and 7, the possibility that the second contact arm 43 and the contact terminal 47 come in contact with the ink K becomes very small.

Departure preventing protrusions 57 are formed on both side surfaces of the housing 31 at positions substantially corresponding to the contact terminals 45 and 47 so as not to cause the connector 11 to depart in a direction parallel to the plane of the main body side substrate 9. The positional departure of the housing 31 is prevented by the protrusions 57.

Next, a structure for bringing the contact terminals 45 and 47 into reliable contact with the conductive connection portions 10 of the cartridge side substrate 15 and the conductive connection portions 12 of the main body side substrate 9 will be described. When the ink cartridge 5 is correctly set into the cartridge receiving section 7, as shown in FIG. 10, the locking portion 23 of the lock lever 17 engages with the locking protrusion 29 and the contact terminals 45 and 47 come in correct contact with the conductive connection portions 10 of the cartridge side substrate 15 and the conductive connection portions 12 of the main body side substrate 9, respectively. However, this is true when the arm portion 27 of the lock lever 17 has an original shape extending linearly. When the arm portion 27 is warped due to any reason such as a shaping problem, the conductive connection portions 10 of the cartridge side substrate 15 may be located above the original positions and thus may not come in correct contact with the contact terminals 45 of the connector 11, in spite of the engagement of the locking portion 23 of the lock lever 17 with the locking protrusion 29.

For this reason, as shown in FIG. 10, a lever shape correcting mechanism 59 shaped integrally with the housing 31 so as to extend upwardly from both sides of the connector 11 in the width direction of the housing 31 is provided. In The lever shape correcting mechanism 59, when the ink cartridge 5 is correctly mounted to the cartridge receiving section 7, a correcting operation portion 61 formed at the upper end of the lever shape correcting mechanism 59 presses the warped arm portion 27 to correct the warping. The lever shape correcting mechanism 59 has such a length that the correcting operation portion 61 of the lever shape correcting mechanism 59 corrects the warping when the ink cartridge 5 is correctly mounted to the cartridge receiving section 7 and thus the contact terminals 45 can come in correct contact with the conductive connection portions 10 of the cartridge side substrate 15 when the ink cartridge 5 is pushed to a predetermined depth position.

The connector according to the invention is not limited to the above-mentioned embodiment, but may be modified in various forms as long as they can accomplish the advantage.

What is claimed is:

1. A connector comprising:

a housing; and a plurality of metal contacts supported so as to be parallel to each other with respect to the housing, each contact having a first contact arm and a second contact arm, and electrically connecting a first member and a second member to each other by bringing a first contact terminal of the first contact arm and a second contact terminal of the second contact arm into elastic contact with a conductive connection portion of the first member and a conductive connection portion of the second member respectively, the first member and the second member being disposed on both sides of the housing, wherein the housing has a through hole penetrating therethrough and formed on a side of the first contact terminal with respect to a first separation start position at which the first contact arm starts separation from the housing, and a second separation start position at which the second contact arm starts separation from the housing is disposed farther apart from the through hole than the first separation start position.

2. The connector according to claim 1, wherein the contacts are arranged so that the first separation start positions of the first contact arms adjacent to each other are alternately arranged in a zigzag manner, and the through holes are arranged in the zigzag manner to correspond to the first separation start positions of the first contact arms.

3. The connector according to claim 1, wherein the housing includes a thin plate-shaped portion to which a side of a base end portion of the contact is attached and a thick base portion located close to a side of the contact terminals of the contact.

4. The connector according to claim 3, wherein the second contact arm is shorter than the first contact arm, a tapered portion inclined so as to be apart from the second contact terminal of the second contact arm is formed at a position of the base portion facing the second contact terminal of the second contact arm, and the tapered portion is formed to extend from the through hole.

5. A recording apparatus comprising the connector according to claim 1, wherein the conductive connection portion of the first member is a conductive connection portion of a cartridge side substrate disposed in an ink cartridge which is mounted to a carriage mounting a recording head and reciprocating in a scanning direction, and the conductive connection portion of the second member is a conductive connection portion of a main body side substrate disposed in the carriage.

6. A housing for supporting a plurality of metal contacts arranged so as to be parallel to each other, each contact having a first contact arm and a second contact arm, and electrically connecting a first member and a second member to each other by bringing a first contact terminal of the first contact arm and a second contact terminal of the second contact arm into elastic contact with a conductive connection portion of the first member and a conductive connection portion of the second member respectively, the first member and the second member being disposed on both sides of the housing, wherein the housing has a plurality of through holes for generating a capillary force and arranged in a zigzag manner.

7. The housing according to claim 6, further comprising a tapered portion to which each of the through holes connects.

* * * * *